US007005980B1

(12) United States Patent
Schmidt et al.

(10) Patent No.: US 7,005,980 B1
(45) Date of Patent: Feb. 28, 2006

(54) PERSONAL RESCUE SYSTEM

(75) Inventors: Larry L. Schmidt, R3291 S. Cedar Cir., Pine, CO (US) 80470; John R. Tuttle, Boulder, CO (US)

(73) Assignee: Larry L. Schmidt, Evergreen, CO (US)

( * ) Notice: Subject to any disclaimer, the term of this patent is extended or adjusted under 35 U.S.C. 154(b) by 56 days.

(21) Appl. No.: 10/640,796

(22) Filed: Aug. 14, 2003

Related U.S. Application Data

(60) Provisional application No. 60/403,841, filed on Aug. 15, 2002.

(51) Int. Cl.
*G08B 1/08* (2006.01)

(52) U.S. Cl. ..... 340/539.13; 340/573.1; 340/692

(58) Field of Classification Search ..... 340/539.13, 340/573.1, 692, 7.6, 7.57, 7.61, 539.15, 540, 340/586; 455/67.11, 9
See application file for complete search history.

(56) References Cited

U.S. PATENT DOCUMENTS

| | | | | |
|---|---|---|---|---|
| 4,468,656 A * | 8/1984 | Clifford et al. | ..... | 340/539.11 |
| 5,289,163 A * | 2/1994 | Perez et al. | ..... | 340/539.32 |
| 5,483,956 A * | 1/1996 | Shapiro | ..... | 128/206.27 |
| 5,652,578 A * | 7/1997 | Snow | ..... | 340/988 |
| 6,121,881 A * | 9/2000 | Bieback et al. | ..... | 340/573.1 |
| 6,199,550 B1 * | 3/2001 | Wiesmann et al. | .... | 128/204.23 |
| 6,624,754 B1 * | 9/2003 | Hoffman et al. | ..... | 340/573.1 |

* cited by examiner

*Primary Examiner*—Phung T. Nguyen
(74) *Attorney, Agent, or Firm*—Rick Martin; Patent Law Offices of Rick Martin, P.C.

(57) ABSTRACT

A personal rescue signal system (PRSS) for quickly finding a transmitting target. More specifically, the PRSS includes as a personal rescue signal device (PRSD), worn on a person and emitting a radio frequency signal in an emergency condition. The PRSD is radio frequency coupled to a receiver within a handheld device and/or base unit. The handheld device would serve in directionally locating the PRSD source signal and also for range finding of the PRSD. One main intention of the PRSS is for rescue of firefighters down, or other operations where human life can quickly be put into harm's way.

34 Claims, 4 Drawing Sheets

PERSONAL RESCUE SYSTEM

CROSS REFERENCE APPLICATIONS

This application is a non-provisional application claiming the benefits of provisional application No. 60/403,841 filed Aug. 15, 2002.

FIELD OF THE INVENTION

The present invention relates to a personal rescue signal system (PRSS). More specifically, the present invention involves a radio frequency signal sent out from a point of origin, the point of origin being a lost, or down, fireman, hiker, skier, etc. The radio frequency is monitored by a base station and/or by a hand held receiver. The PRSS allows the hand held receiver to directionally track the point of signal origin and thus allow rescue of an individual that is in trouble, or lost.

BACKGROUND OF THE INVENTION

The ability to find and rescue a person in trouble often times is a matter of a critical time period. For example, the time to find and rescue a downed fireman is very critical and limited depending on the oxygen he/she may have left along with the fire ground situation itself. If a firefighter is hurt, and is within a fire ground situation, the situation and personal safety of the person can degrade very quickly. Time is 'the' critical factor in bringing a firefighter out of a situation alive.

Finding a lost fire fighter in a commercial or residential fire is often very difficult. The rescue methods used in today's firefighting are very basic. One method is to follow the person's hose line, assuming they are on one. Many fire situations have a plurality of hoses at the scene and finding one person on one hose in a timely manner is not an easy task. If the downed or lost person has a personal alert safety system (PASS), then following the audible signal emitted by the PASS will hopefully find the person in trouble. Some PASS systems also have an optional visual light to help find a person, assuming you can see well enough as you near the person in trouble. A PASS system is usually worn as part of a firefighters self-contained breathing apparatus (SCBA).

A PASS system has a purpose to sound a loud, highly discernible audio alarm if a distress condition occurs. The device will sense an absence of motion if the wearer becomes immobilized for about 25 seconds. It will also activate at a preset "low air" condition, usually about 10% or 10 minutes. Its alarm must function in the manual or automatic mode to assist rescue crews in locating the firefighter in distress. PASS devices must be highly reliable and easy to operate. They usually require an alarm sound output of at least 95 dBA, measured at ten feet. Two important parameters of sound that must be considered are sound intensity (loudness) and sound discernability (the ability to recognize a particular sound in a high background noise environment). Some of the earlier PASS devices had a loud sound, but were difficult to distinguish above the noise associated with the typical fire ground. Present day PASS devices have helped overcome the problem of locating the source of the sound signal by modulating a pure tone, or generating a sound that consists of several intermittent tones or use of a sweep frequency. A sweep frequency type of sound will generate multiple tones that sweep from 2,000 cycles thru 6,000 cycles so as to be not easily masked by background noise.

The main sensor that permits a PASS device to operate in the automatic mode is called the motion sensor transducer. This is the heart of the PASS device. If the sensor is not sensitive enough to sense random motion, the device will constantly go into pre-alert, becoming a nuisance to firefighters and may discourage activation. The ideal sensor is one that only requires normal motion to keep the PASS inhibited, yet is sensitive enough to immediately sense a lack of motion when a firefighter is immobilized. If a firefighter disables the PASS system, it leaves he/she at risk.

There are a number of methods of sensing motion. Some PASS manufacturers use mechanical devices, such as a small metal ball to sense motion. The random motion of the ball is converted into an electrical signal as long as motion exists. Another popular method to sense motion is accomplished by the closing of a mercury filled switch. Still another method uses a ball inside an infrared light chamber. The motion of the ball interrupts the light signal and is sensed as motion. Perhaps the most progressive method involves a solid-state accelerometer device that can sense a broad range of motion, and is not position sensitive.

Most PASS manufacturers use a custom microchip or a microprocessor to process the signal. Some chip functions are sensing low battery, motion, sound, and light generation. A quartz crystal may be used to ensure accurate timing. Switching is another aspect of PASS alarms. PASS alarms are required to be automatically switched from the 'storage mode' to the 'sensing mode', without independent action by the wearer. Many manufacturers use a mechanical switch to activate their PASS devices. A recent improvement is all-electronic switching. These switches must be reliable and easy to operate, even with a gloved hand. A properly used PASS will save lives.

The major problem with a PASS system in itself is that it does not always allow for a rescuer to have the ability to quickly pinpoint a downed person. Another problem is in the case of a plurality of downed firefighters. A plurality of audible alarms would tend to disorient a rescuer and also not give a rescuer the ability to know how many firefighters may be down or in trouble. Nor would a rescuer(s) know how close they would be to the downed person. In fire situations, smoke can become so heavy as to not allow a rescuer to be able to see very far in front.

The present invention solves these aforementioned problems by allowing for a radio signal to be initiated when a firefighter is in trouble, also allowing for each firefighter to have a special decoded signal. Decoded signals would allow a base unit to know exactly how many people are in trouble, and also their temperatures, other vital measurements, and room temperature of the firefighter. The present invention provides a radio frequency signal that allows the rescuer(s) to know the direction, range and number of firefighters that are in trouble. The present invention can be a stand-alone device or can be integrated and triggered by a PASS system thus making use of the motion detection and/or air low alerts within the PASS itself. The present invention allows for direction and range of firefighter(s) in trouble and can help save lives by reducing the time it takes to perform a rescue.

SUMMARY OF THE INVENTION

The main aspect of the present invention is to provide a personal rescue signal device (PRSD), worn on a person and emitting a radio frequency signal.

Another aspect of the present invention is to provide a handheld receiver (HHR) means for directional locating of the PRSD.

Another aspect of the present invention is to provide a means for range finding of the PRSD.

Another aspect of the present invention is to provide a means to add a code within the PRSD radio frequency signal to allow a base unit to detect one or more separate transmissions and thus discern the number of person(s) in trouble or lost.

Another aspect of the present invention is to decrease the rescue time and increase the survival probability in rescue operations.

Another aspect of the present invention is the ability for integration of the PRSD within the PASS system alarm activation circuitry.

Another aspect of the present invention; an alternative embodiment is to pass vital parameters of firefighters such as body temperature and room temperature in the vicinity of the firefighter.

Another aspect of the present invention, an alternate embodiment, is to allow for audio and visual options for a stand alone PRSD, that is a PRSD independent of the PASS.

Another aspect of the present invention is to provide the transmitter with 3 different means to activate:

1) When fire fighter does not move for 30 seconds;
2) Room temperature sensor;
   a) starts monitoring when room temperature gets over 200 degrees fahrenheit;
   b) sends out alarm to command center when temperature reaches over 500 degrees fahrenheit.
3) Manually by pushing button on top of transmitter.

Yet another aspect of the present invention, an alternate embodiment, is to provide a PRSD with an optional audio and/or video receiver, along with providing the base unit with a transmitter.

Other aspects of this invention will appear from the following description and appended claims, reference being made to the accompanying drawings forming a part of this specification wherein like reference characters designate corresponding parts in the several views.

The present invention, although primarily intended at finding a lost or downed firefighter, is also applicable in many other applications such as lost miners, hikers, skiers, children in large crowd situations, or other personal use. It can also be applied to use within cars or other non-human applications. Some examples are use in finding a vehicle in a large parking lot, robot tracking, animal tracking, etc.

The entire personal rescue signal system (PRSS) would consist of the following:

A) A PRSD that would trigger a radio frequency alarm signal, said alarm signal allowing for an optional embedded decoded signal. The PRSD could be a stand-alone device supplemented with its own audio and/or visual alarms or it could be integrated into a PASS system to utilize the PASS audio and visual alarms in conjunction with its radio frequency alarm signal.

B) A hand held receiver (HHR) to allow a finder to have directional and range indicators on a handheld receiver (visual or vibration—or audio).

C) A base unit (BU) to allow receipt of PRSD radio transmission(s), allow decoding (if present) of the transmitted signal(s). Note: the BU could be supplied as an optional device.

D) Alternate embodiments of the present invention would allow for the PRSD to contain a receiver, allowing the HHR to have a transmitter, and allowing the BU to have a transmitter. These added optional features would enable additional communications between all devices.

Other features and advantages of the present invention will become apparent from a consideration of the ensuing detailed description and drawings.

DETAILED DESCRIPTION OF INVENTION

Partial Glossary of Terms

PRSS—personal rescue signal system
PASS—personal alert safety system
SCBA—self contained breathing apparatus
PRSD—personal rescue signal device
HHR—hand held receiver
BU—base unit The present invention provides a PRSS which includes a personal rescue signal device (PRSD), worn on a person and emitting a radio frequency signal. The PRSD is radio frequency coupled to a receiver within a handheld device and/or base unit. The handheld device would serve in directional locating and also for range finding of the PRSD.

The main embodiment of the present invention PRSS is related to firefighting safety and rescue. It should be noted that although firefighting is described below as the main embodiment, there are other applications of the present invention, some of which will be briefly discussed.

In the main embodiment, the PRSD is attached to a PASS, which is, in turn, coupled to a SCBA. The aforementioned PASS alarm system would be tied to the PRSD for radio signal activation. It should be noted that PASS systems could have various air containers for 30 minute to 1-hour capacity. A firefighter would activate the SCBA and PASS prior to building entry.

The PRSD can be supplied with the optional ability of embedding a code within the PRSD radio frequency signal. An optional base unit would receive the coded signal. A coded signal, each code being unique for a particular PRSD, would allow a base unit to detect one or more separate transmissions and thus discern the number of person(s) in trouble. Although unique identification of person(s) transmitting a signal is possible, in fire situations it is not practical. Unique identification is usually not practical because firefighters leaving a station house usually grab a SCBA device as they leave a firehouse and an individual SCBA is not usually directly tied to an individual. A PASS is tied within a SCBA and a PRSD is tied (electrically or audibly) to the PASS. Once a PASS alarm is activated, the PRSD would send out an emergency radio frequency signal. Use of a base unit would allow base-monitoring personnel to alert a rescue team to activate their hand held units and proceed in a rescue attempt. If no base unit were present, then the rescue team would continually monitor for an emergency radio frequency signal from a PRSD via the HHR.

There are several design options in possible activations of the PRSD emergency radio frequency signal such as:

1. When the PASS alarm is activated in one of the following ways:
   A. An electrical connection input from the PASS alarm electronics; or
   B. A frequency/amplitude audio sound detector within the PSRD to sense the audio PASS alarm.
   Note: A and B above apply to use of a PASS on a SCBA system in fire rescue operations.
2. A direct alarm button on the PRSD for use in non-PASS applications. For example, a lost minor or skier.

Once the alarm on a PASS is activated, it would couple into the PRSD (electrically or audibly) to activate the radio frequency signal. The radio frequency signal would be transmitted to a base unit and to a hand held device. The radio frequency signal would act as a homing device for both directional and range finding detection. If no base unit was supplied, then outside personnel would monitor interior firefighters with the hand held receiver (HHR). Once a signal is received by either or both the hand held and/or base unit, a rescue operation would immediately begin.

There are established protocols in setting up rescue teams, the details of which will not be described herein. Rescue teams are usually made up of at least two firefighters for entry into a site with at least one firefighter remaining outside the burning site. Entry personnel would carry a HHR.

The HHR would be best described as a pistol type device with a button type trigger for activation. Activation would also turn on a laser light that would throw a laser beam in the pointed direction when control circuitry dictated, based on signal strength from the PRSD. Feedback from the PRSD to the HHR and thus to the rescue person would be audio and visual. In many fire situations, the rescuer may face a situation of bad visibility and/or site noise. The ability to have a signal emitting from a building site prior to entry would pinpoint a building area or section, thus eliminating time in having to search other building sectors.

The HRR would allow the rescue team to be able to narrow the search to a building sector prior to entry. The HHR carried by the entry rescuer(s) would have audio feedback to a built-in speaker that would increase in intensity as the HHR is pointed in the direction of a PRSD and decrease as it is moved away. Visual feedback would hold a green light 'on' when the HHR is pointed in the direction of the PRSD and turn a red light(s) 'on' when pointed away from the PRSD. The HHR would also have a vibration feedback as a backup to the red/green lights. The vibration would peak when the HHR is pointed in the direction of the transmitting PRSD. Not only does the HHR allow the rescue team to establish a sector in which the PRSB alarm is being sent but also allow for determination of locations if multiple PRSD's are signaling. The HHR makes it possible to sweep an area and see a plurality of maximum audio and visual indicators 'on' when there are more than one PRSD sending distress signals. The HHR would also have a range indicator. For example, a number of LED's in a row can light up more and more LED's as the HHR closed in on the distance to the PRSD. It should be noted that the HHR, although with a design specifically described above, other designs can be incorporated to perform the same function(s).

The HHR would also contain a laser light. The laser light would activate with the trigger button in conjunction with its control circuitry. The laser light would throw a beam in the direction of the pointed HHR and would assist a rescue team in seeing ahead. For example, in heavy smoke, a wall between the rescue team and the firefighter down would quickly detected to alert the rescue team to find an alternate rescue route. The laser would also serve to help others on the rescue team see the HRR directional indication.

The HHR would contain an auto ranging algorithm. As such, an auto ranging algorithm would memorize signal intensities and normalize the "highest" signal intensity received from feedback of the PRSD direction. The algorithm would then use the normalized signal to activate the green light, audio, and vibrator peak amplitude. As such, the green light indicator, vibrator and audio feedback to the rescue person holding the HHR would always indicate direction, regardless of PRSD range.

An alternate embodiment of the present invention is to provide the HHR with a transmitter. The transmitter could be utilized for audio signaling to the PRSD. For example, voice activation or a series of beeps would tell the firefighter down that rescue is on the way.

The antenna on the HHR would be a directional antenna. There are two types of antenna that can be employed. The main embodiment would entail use of an antenna that would receive the peak signal only at one point, that is, pointed in the direction of sending signal transmission source. Another antenna that could be employed is a null point antenna. A null antenna is still a directional antenna but is designed to have a minimum strength reception when pointed at the signal transmission source. A design for direction finding could consist of one or both of the aforementioned type antennae.

Once a firefighter is in trouble, the HHR homing to the sending PRSD(s) will decrease the rescue time and increase the survival probability in rescue operations. Rescue time will be decreased due to the ability to point to a sector of the building, thereby eliminating unnecessary search in other sectors, allow the rescue team to pinpoint the direction and range and thus quickly get to the PRSD(s) location, and thus the firefighter(s) that is in trouble.

Having an option base unit (BU) is an advantage in larger operations. The BU would be located in a strategic area from the site such that it is safe from collapsing building debris, etc. Having a BU would allow BU personnel to concentrate their attention to PRSD radio signals, alert a rescue team, and, when PRSD have coded signals, to alert the rescue team to exactly how many firemen are in trouble. It would thus allow the rescue team to activate their HHR's at the point of a rescue initiation. If no BU were present, the rescue team would be on a 100% monitor level outside of the burn site.

A BU, although not limited to the following, would have the following functionality:

A. Ability to communicate with the HHR and/or PRSD;
B. Ability to download fire building site diagrams for aid in helping the rescue team track a firefighter down;
C. Ability to determine, with coded PRSD transmission signals, how many firefighters are down;
D. Ability to track the rescue team based on communication with the rescue team;
E. Ability to determine building service connections, based on downloaded information, for assistance in helping the firefighter and rescue team locate gas, electrical, water and other service points;
F. Other functions required by the user of a PRSS system.

The present invention also allows for a stand-alone system. That is, to allow for audio and visual options for a stand alone PRSD, a PRSD independent of the PASS. In this alternate embodiment, the PRSD would have its own motion detector, battery, and other alarms. A radio frequency distress signal would be sent to a HHR independent of any other system. Each PRSD would also have a removable cover to allow for battery replacement or other maintenance.

The PRSD could also have a user (wearer) set activation. For example, a lost or hurt minor could push a button to activate the device. The PRSD would then allow surface personnel to be able to quickly pinpoint the individual in distress without having to solely rely on maps, which may have some inefficiency. This would be particularly helpful in mine collapses where the lost individual position is required as soon as possible.

An alternate embodiment of the present invention is to allow for a stand alone PRSD, that is a PRSD independent of the PASS. In this alternate embodiment, the PRSD would be able to function in PASS independent environments, such as use for mining employees, children, robotics, etc.

Providing a PRSD with an optional audio and/or video receiver, along with providing the base unit with a transmitter is yet another alternate embodiment of the present invention. In this alternate configuration, the base unit would be able to send voice, signal data and/or a visual signal to the PRSD. In this manner the firefighter down would be aware of a voice or other signal to know that rescue has confirmed an emergency situation and that help is on the way.

The present invention, although primarily described with reference to finding a lost or downed firefighters it is also applicable in many other applications such as lost miners, hikers, skiers, children in large crowd situations, or other personal use. It can also be applied to use within cars or other non-human applications. Some examples are use in finding a vehicle in a large parking lot, robot tracking, animal tracking, etc.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

Figure 1:
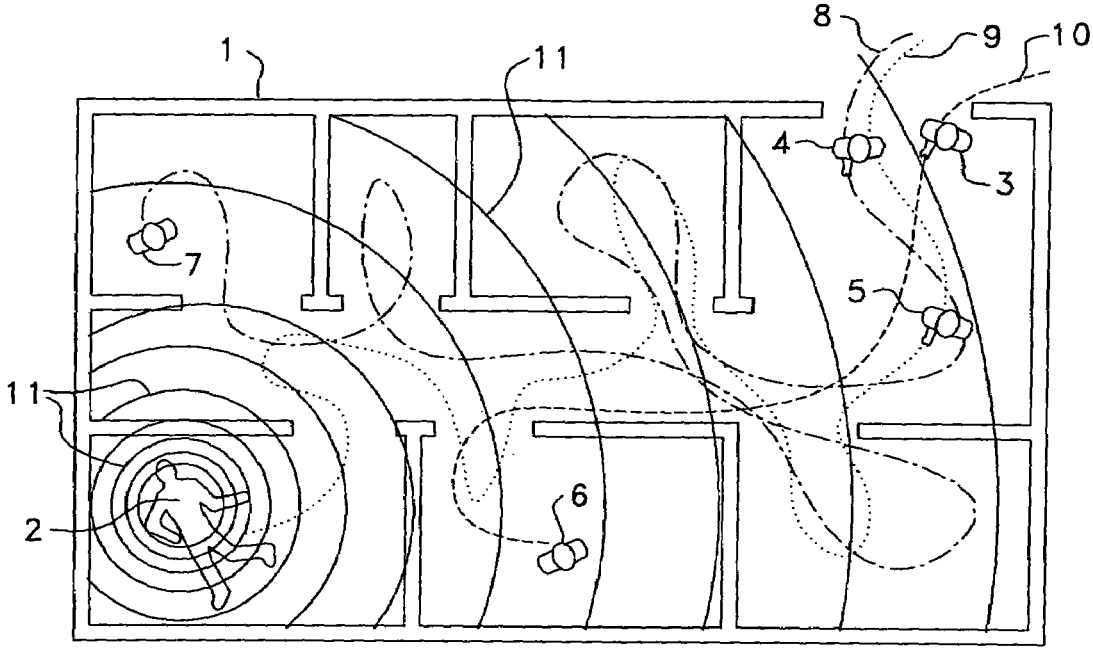
FIG. 1 (PRIOR ART)
FIG. 1 is an overhead depiction of firefighter down and a rescue team inside a building using PASS alarms (prior art).

FIG. 1 is an overhead depiction of firefighter down 2 and rescue team firemen 3, 4, 5 inside building 1 using PASS alarms (prior art). PASS alarm sends out audio signal 11. In this depiction there are three hoses 8, 9, 10 within building 1. When PASS alarm sends out audio signal 11 and audio signal 11 is heard, a rescue team is put into action. In the depiction illustrated, firefighter down 2 has hose 9 whereas there are two other firefighters 6, 7 with hoses 8, 10. Thus, the rescue team must follow each individual hose; not knowing which hose that firefighter down 2 is carrying. As can be seen in the illustration, rescue team firemen 3, 4, 5 are each following one hose 8, 9, 10 to perform a building search. With internal (and external) noise, and poor visibility, the rescue attempt can be easily hampered. Each rescue fireman must follow an individual hose to get to firefighter down 2. The time that it takes to find firefighter down 2 is critical in a successful rescue.

Figure 2:
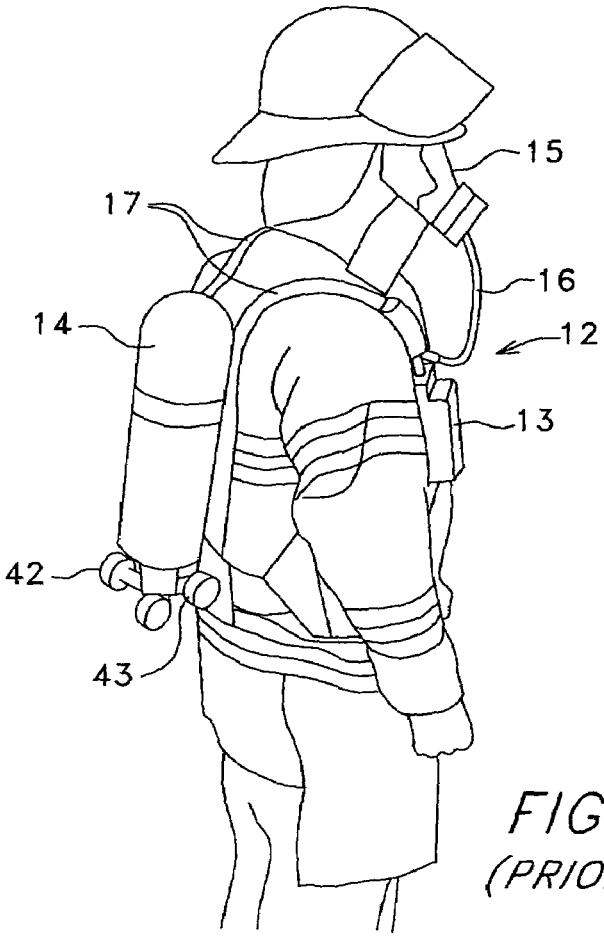
FIG. 2 (PRIOR ART)
FIG. 2 is a side view of a firefighter with a SCBA and PASS system (prior art).

FIG. 2 is a side view of typical firefighter 12 with a SCBA system and PASS 13 system (prior art). SCBA system has an attach body harness 17 and consists of air tank 14, headset/respirator 15, air hose 16 and other items (details of which are not shown) such as an ear speaker, voice speaker air and time gauge, etc. Air tank 14 can typically be supplied in 30, 45, or 60-minute air capacities. PASS 13 is attached to the SCBA body harness 17 and will send alarms (audio and visual) as previously discussed when a firefighter stops motion or gets low on air supply. The audio alarms will emit from alarm speakers 42, 43 located on either backside of the SCBA under air tank 14.

Figure 3:
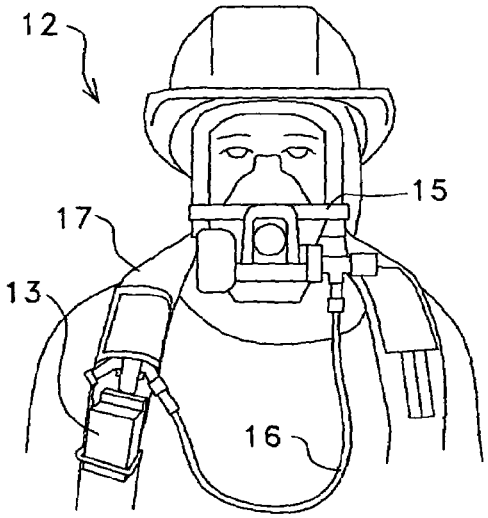
FIG. 3 (PRIOR ART)
FIG. 3 is a front view of a SCBA and PASS system on a firefighter (prior art).

FIG. 3 is a front view of a SCBA and PASS 13 system on firefighter 12 (prior art). PASS 13 is attached to the SCBA body harness 17. Firefighter 12 wears headset/respirator 15, to which is attached air hose 16. In an emergency, PASS 13 will send out an audio alarm and may also have a visual light attached to it.

Figure 4:
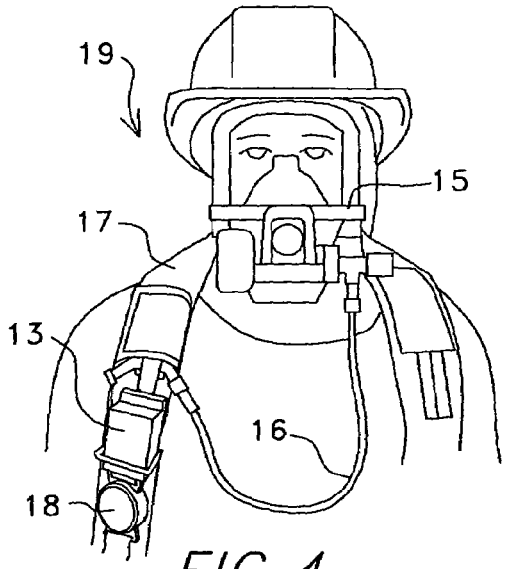
FIG. 4 is a front view of a PRSD of the present invention interconnected with a PASS on a body harness of a SCBA system as worn by a firefighter.

FIG. 4 is a front view of PRSD 18 of the present invention interconnected with PASS 13 on body harness 17 of a SCBA system as worn by firefighter 19. The interconnection of PASS 13 and PRSD 18 would be such that PRSD 18 is activated when PASS 13 is activated. There would also be a signal alarm connection from PASS 13 to PRSD 18. When an alarm condition is detected by PASS 13, PRSD 18 is sent an alarm signal such that PRSD 18 would, in turn, activate an emergency radio frequency signal to be detected by a HHR or BU.

Figure 5:
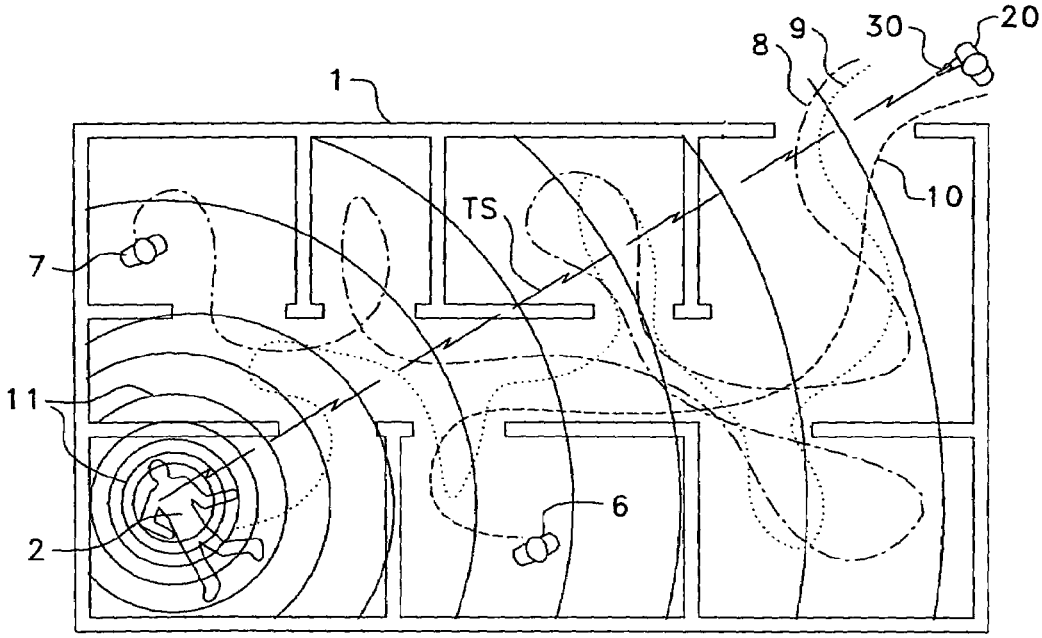
FIG. 5 is an overhead illustration of the present invention showing a firefighter down and a rescue team firefighter entering a building using a HHR for locating the firefighter down.

FIG. 5 is an overhead illustration of the present invention showing firefighter down 2 and rescue team firefighter 20 entering building 1 using HHR 30 for locating firefighter down 2. The PRSD worn by firefighter down 2 is sending out emergency radio frequency signal TS (also called a rescue demand signal). Rescue team firefighter 20 is holding activated HHR 30 to get a directional target for the transmitting PRSD on firefighter down 2. With this system of the present invention, rescue team firefighter 20 knows the direction of firefighter down 2 and can pinpoint firefighter down 2 to a building quadrant. As rescue team firefighter 20 enters the building there is not a need to follow a hose (see FIG. 1) or search other rooms unnecessarily. HHR 30 will lead rescue team firefighter directly and quickly to firefighter down 2, saving precious time in a rescue operation. HHR 30 will also have a rangefinder to give feedback to rescue team firefighter 20 as the target PRSD is approached. Thus, the present invention allows for a faster and more efficient rescue operation by giving directional feedback to the rescue team along with rangefinder capabilities.

Figure 6:
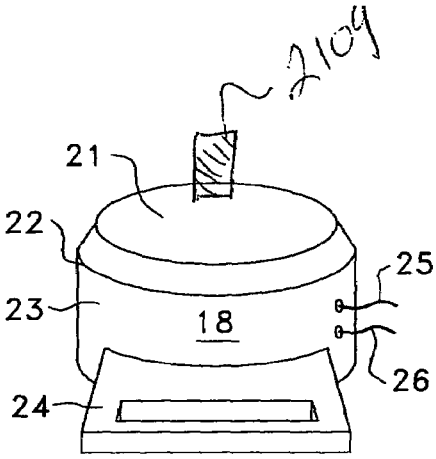
FIG. 6 is a close-up front perspective view of a belt attach PRSD of the present invention.

FIG. 6 is a close-up front perspective view of belt attach PRSD 18 of the present invention. Belt attach PRSD 18 has a removable top 21 for accessing internal electronics and battery. PRSD base 23 contains the electronics and battery and is connected to removable top 21 at top-to-base junction 22. Belt attach base 6 is designed for typical belt or harness attachments. There are two electrical connections on the PRSD. Activation power wire 26 is an input from a PASS (or other system) to initiate activation of the PRSD. Alarm signal wire 25 is an input from a PASS to activate the aforementioned emergency radio frequency signal TS to be transmitted by the PRSD. The PRSD can also be designed as a standalone device, independent of a PASS direct tie-in.

That is, the PRSD can always be in standby state and not require activation power wire 26. Another embodiment of the PRSD is to have it independent of any PASS circuitry and have the PRSD designed with a frequency/amplitude detector. In this embodiment the PRSD could be placed as a standalone device on the SCBA and in the vicinity of the PASS audible alarm speakers 42, 43 located on either backside of the SCBA under air tank 14 (see FIG. 2). The PRSD frequency/amplitude detector would sense a PASS audible alarm and immediately activate the emergency radio frequency signal TS. It should be noted that although the PRSD shown is designed to attach to a PASS, alternate embodiments of the present invention can have the power and alarm signal activations performed by other systems or by the wearer of the PRSD with simple power switches and alarm buttons.

Figure 7:
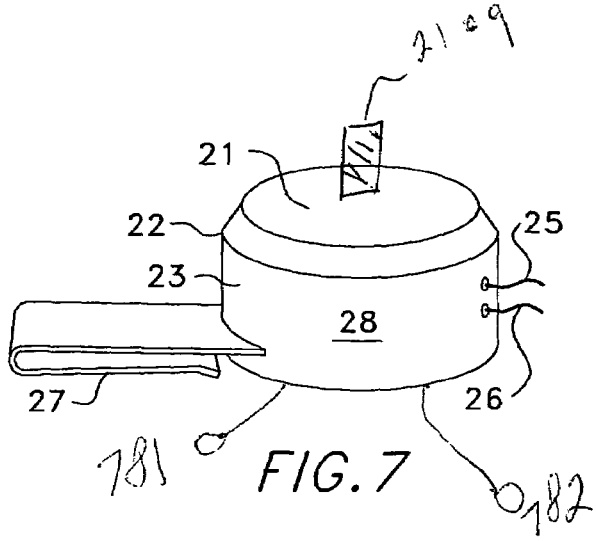
FIG. 7 is a close-up front perspective view of a clip mount PRSD, an alternate embodiment of the present invention.

FIG. 7 is a close-up front perspective view of clip mount PRSD 28, an alternate embodiment of the present invention. FIG. 7 is similar to FIG. 6 with; the exception of attach clip 27. This alternate configuration would allow a PRSD to be mounted to clothing, waist belts, or other areas of attachment. Likewise, power and alarm signal wire 25 and power signal wire 26 activations could be performed by other systems or by the PRSD wearer via simple power switches and alarm buttons.

The button 2109 is used for:

1) Button 2109
   a) manual alarm
   b) 1 click activates system to wake-up
   c) 2 clicks send distress alarm to command center
   d) 3 clicks disarms box
2) System can also;
   a) alarm command center
      1) determines heat in room where firefighter is in with thermocouple 781;
      2) activates when firefighter has not moved for 30 seconds;
      3) senses body skin temperature with thermocouple 782.

Figure 8:
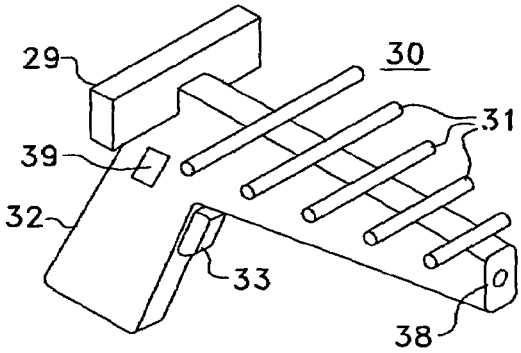
FIG. 8 is side perspective view of a HHR.

FIG. 8 is side perspective view of HHR 30. HHR 30 contains receiver electronics (not shown), hand pistol grip 32, activation button 33, directional antenna 31, display 29, sound speaker 39, and laser light 38. An internal vibration unit (not shown) is also a part of the HHR. A base unit would alert a rescue team firefighter that an emergency radio frequency signal TS has been activated by a PRSD. The rescue team firefighter (or other personnel in other applications) would then activate HHR 30 to begin rescue operations. In a case where a base unit was not supplied, the rescue team firefighter (or other personnel in other applications) would activate HHR 30 and constantly monitor a fire scene for an emergency radio frequency signal TS. Once a rescue operation is begun, HHR 30 would provide the rescue team with directional feedback via visual lights on display 29, audio signal via sound speaker 39 and vibration. Laser light 38 would assist others on the team in visual detection of the direction of the transmitting PRSD and help to reveal potential obstacles not easily visible in heavy smoke etc. Although HHR 30 is depicted in FIG. 8 as a particular design, other design configurations could easily be adapted to contain the HHR function of receiving an emergency signal and providing a directional and rangefinder function.

Although the main embodiment of the present invention entails use of directional antenna 31, which would receive the peak signal only at one point, that is, when HHR 30 is pointed in the direction of sending signal transmission source, another embodiment could employ a null point antenna. A null antenna (not shown) is still a directional antenna but is designed to have a minimum strength reception when pointed at the signal transmission source. A design for direction finding could consist of one or both of the aforementioned type antennae.

Figure 9:
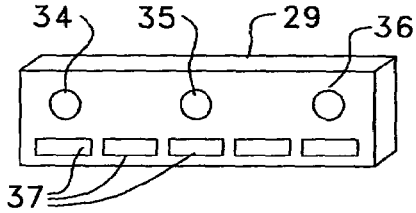
FIG. 9 is a front perspective view of the display of a HRR.

FIG. 9 is a front perspective view of display 29 of HHR 30. Display 29 contains a rangefinder and directional indications. In the design shown, the rangefinder is displayed as a series of rangefinder LED's 37. More LED's would light up as a rescue person got nearer to a PRSD sending out an emergency radio frequency signal. Red lights 34, 36 would illuminate when HHR 30 is pointed away from a transmitted emergency radio frequency signal and green light 35 would illuminate when HHR 30 is pointed in the direction of the PRSD sending the emergency radio frequency signal. Alternate embodiments of HHR 30 could consist of, but not be limited to the following:

A. A speaker and an audible signal that would increase in amplitude or frequency or both as HHR 30 is pointed towards a transmitting PRSD and peak as HHR 30 is directly pointed at the transmitting HHR.
B. A digital (or needle gauge) rangefinder display to replace the LED's shown.
C. A transmitter to allow communications with the PRSD and/or BU.
D. A device mounted permanently into a BU. This could be used for other applications where only a target direction is needed and no one is directly seeking a target.

Figure 10:
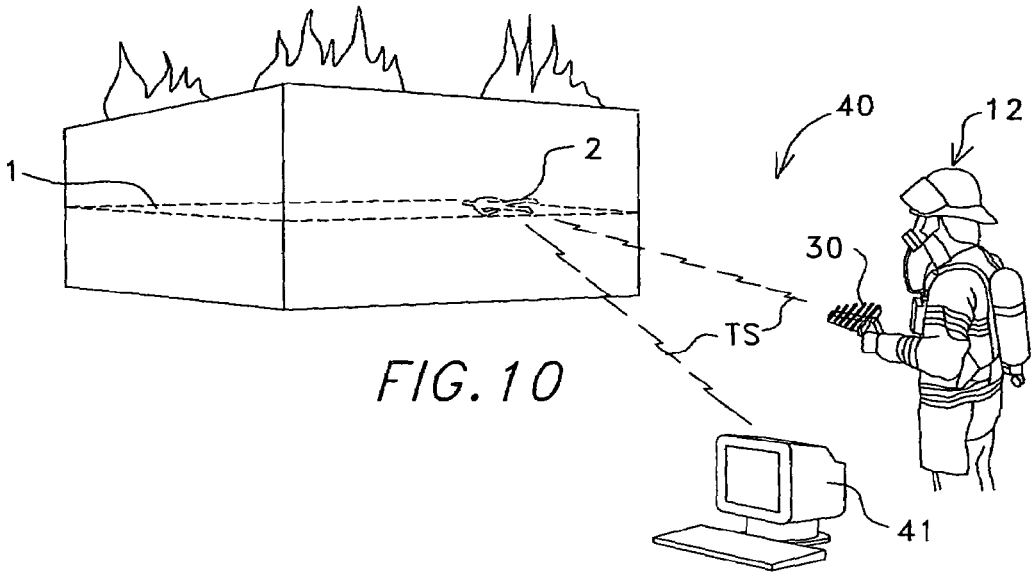
FIG. 10 is an illustrative diagram of the present invention in use, showing an overall PRSS system with a PRSD transmitted emergency radio frequency signal, HHR, and BU.

FIG. 10 is an illustrative diagram of the present invention in use, showing an overall PRSS system 40 with a PRSD transmitted emergency radio frequency signal TS, HHR 30, and BU 41. PRSD on firefighter down 2 has activated emergency radio frequency signal TS. BU 41 is alerted to an emergency situation and initiates the rescue operation. Rescue team firefighter 12 activates HHR 30 and quickly can pinpoint the direction of emergency radio frequency signal TS. In this case firefighter down 2 can be quickly pinpointed to the $2^{nd}$ floor and to the front right quadrant of the building, thus saving very precious initial search and rescue time.

Figure 11:
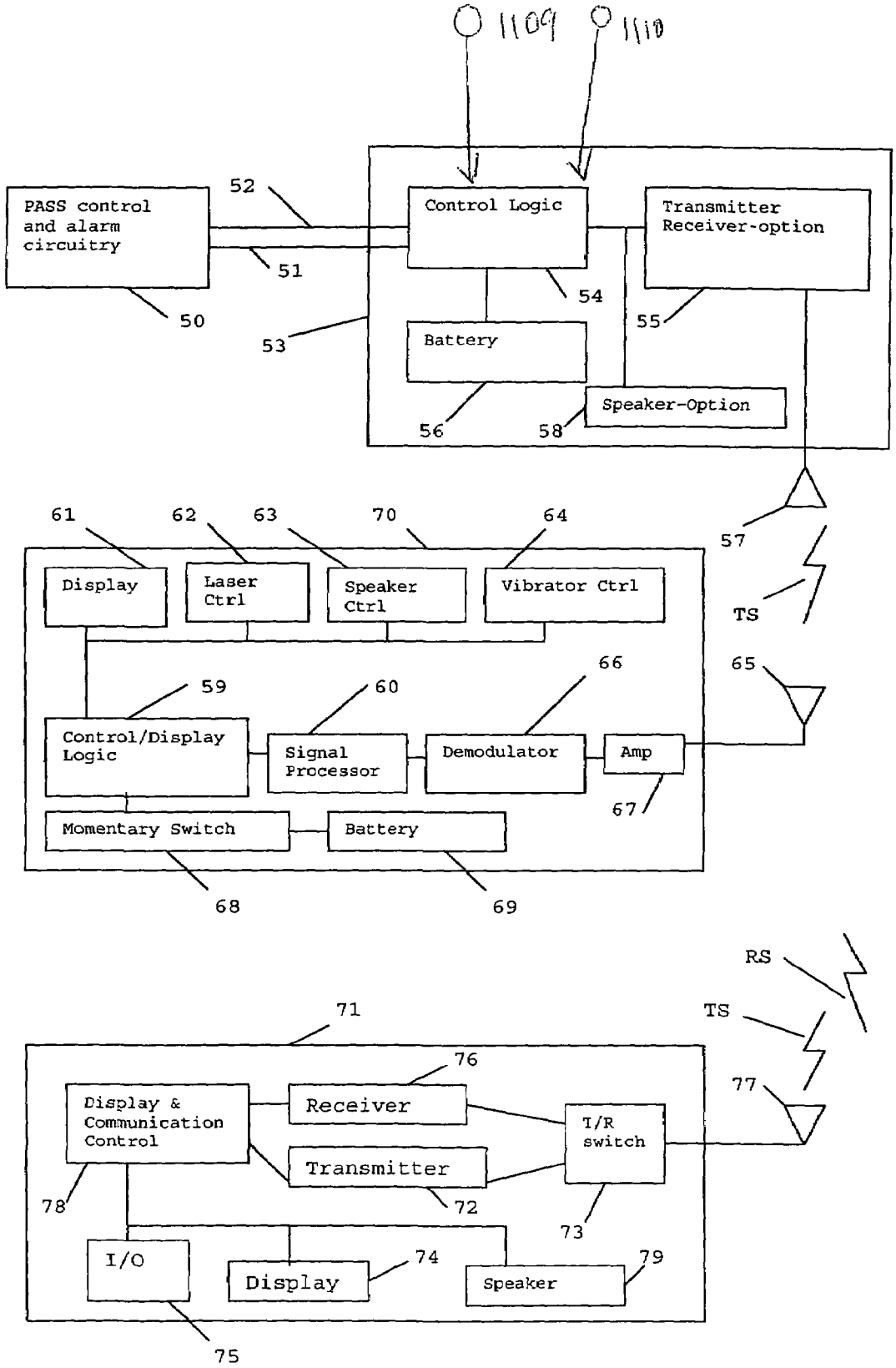
FIG. 11 is a block diagram of the entire PRSS showing the electronics for the PRSD, HHR, and BU.

FIG. 11 is a block diagram of the entire PRSS showing the PRSD electronics 53, HHR electronics 70, and BU electronics 79. It should be noted that all electronics and controls do not necessarily show all components but rather are used to illustrate the function of each item.

PRSD electronic block 53 shows the PRSD connected to PASS control and alarm circuitry 50. The PRSD electronics will remain in a 'standby' mode until activate power wire 51 senses an active state from PASS. This will conserve power from PRSD battery 56. When a fireman activates the PASS system on a SCBA, activate power wire 51 goes to an active state. If PASS control and alarm circuitry 50 detects an emergency condition, PASS alarms are activated and PASS alarm control wire 52 goes to the active state. PRSD control logic 54 will then immediately activate transmitter 55 to send one or more emergency radio frequency signals TS out via PRSD antenna 57. Receipt of emergency radio frequency signal TS will then be received by a BU or HHR or both for initiation of a rescue team operation. As aforementioned, the PRSD can be equipped with optional speaker 58. This option, along with a receiver would allow a firefighter down to hear a rescue signal or voice. It should also be noted that a PRSD can be designed to continually be in standby mode, that is, activate power wire 51 could be eliminated.

There are several other design options in possible activations of the PRSD emergency radio frequency signal. For example, the above electrical connections, alarm control wire 52 and activate power wire 51 input from the PASS alarm electronics can be eliminated and the PRSD could be a stand alone device. As such the PRSD would have an internal frequency/amplitude audio sound detector to sense the audio PASS alarm and then activate the emergency radio frequency signal TS. Other PRSD applications could be designed with a direct alarm button on the PRSD for use in non-PASS applications. For example, a lost minor or skier.

An optional body skin temperature sensor 1109 and/or ambient temperature sensor 1110 could also activate the transmitter 55.

HHR electronics 70 is activated with momentary switch 68. Although momentary switch 68 would conserve HHR battery 69 power when the HHR is not activated, an override 'on' switch (not shown) can also be incorporated in the HHR design. When activated, HHR electronics 70 will receive emergency radio frequency signal TS. Directional antenna 65 will feed back emergency radio frequency signal TS through amplifier 67, demodulator 66 and into signal processor 60. The aforementioned auto ranging algorithm would normalize emergency radio frequency signal TS. Control and display logic 59 would then send control signals to display control 61, speaker control 63 and vibrator control 64 providing visual, audio, and mechanical feedbacks to the rescue firefighter holding the HHR. Thus, as aforementioned, the rescue firefighter would use one or all of the HHR feedbacks to get a directional location of the PRSD (on firefighter down). Laser control 62 would activate the laser light on the HHR providing a visual direction to the rescue team. The rescue firefighter holding the HHR would sweep an area to determine if more than one transmission is being received. A plurality of PRSD transmissions would provide a respective plurality of HHR feedbacks allowing the rescue team to determine the number of firefighters down and their respective directions from the HHR. As aforementioned, the HHR could be equipped with an optional transmitter (not shown) to allow a rescue fighter to send signal or voice to the firefighter down.

BU electronics 71 would be in a monitoring mode and located outside the fire zone danger area. When BU electronics 71 receives emergency radio frequency signal TS from an emitting PRSD unit, a rescue effort will be initiated. BU antenna 77 picks up emergency radio frequency signal TS via receiver 76, display and communication control 78 would provide a visual alarm to display 74 and audio alarm to speaker 79 warning the BU operator of an emergency condition. The BU operator would then initiate a rescue operation. BU electronics 71 would also be equipped with an input/output I/O 75 that would allow the BU operator to communicate with the rescue team and/or firefighter down via output signal RS.

The PRSS system thus allows for timely communication of an emergency condition and can save precious time in a rescue operation.

As aforementioned, the present invention, although having been primarily described with reference to finding a lost or downed firefighter, is also applicable in many other applications such as lost miners, hikers, skiers, children in large crowd situations, other personal use, use within vehicles, robotics, animal tracking, etc.

Although the present invention has been described with reference to preferred embodiments, numerous modifications and variations can be made and still the result will come within the scope of the invention. No limitation with respect to the specific embodiments disclosed herein is intended or should be inferred.

We claim:

1. An emergency locator system comprising:

a victim mounted personal alert safety system (PASS):

a housing for the PASS;

a victim mountable alarm receiver;

a victim mountable radio transmitter connected to the alarm receiver;

a control circuit to activate the radio transmitter to send a rescue demand signal when the alarm receiver receives an alarm signal;

a housing for the victim mountable alarm receiver, the victim mountable radio transmitter, and the control circuit;

a connection between the PASS and the victim mountable alarm receiver; and a remote radio receiver coupled to a display unit which indicates a distance and a direction of the rescue demand signal.

2. The system of claim 1, wherein the alarm receiver receives a signal from a victim mountable motion detector in the PASS.

3. The system of claim 1, wherein the alarm receiver receives a signal from a victim mountable low air sensor in the PASS.

4. The system of claim 1, wherein the alarm receiver receives a signal from a victim mountable device having a motion detector and a low air sensor in the PASS.

5. The system of claim 1, wherein the rescue demand signal has a unique signature to identify the identity of the rescue demand signal.

6. The system of claim 5, wherein the display unit further comprises a base unit that can receive multiple rescue demand signals and indicate each rescue demand signal and its direction and distance from the base unit.

7. The system of claim 6 further comprising a hand held receiver (HHR) which indicates the direction and distance of a rescue demand signal.

8. The system of claim 7, wherein the base unit has a receiver that can communicate with the HHR and the victim mountable transmitter, wherein the HHR has a transceiver to communicate with the base station.

9. The system of claim 6, wherein the base unit further comprises a computer to receive building site data to help locate the rescue demand signal.

10. The system of claim 1, wherein the control circuit also activates a victim mountable audio and/or video alarm.

11. The system of claim 1, wherein the display unit further comprises a hand held receiver which indicates distance and direction of the rescue demand signal.

12. The system of claim 11, wherein the hand held receiver (HHR) further comprises a pistol type device.

13. The system of claim 11, wherein the hand held receiver (HHR) further comprises a speaker that would increase in volume as the HHR is pointed in the direction of the rescue demand signal.

14. The system of claim 11, wherein the hand held receiver (HHR) further comprises a visual feedback to indicate the direction of the rescue demand signal.

15. The system of claim 11, wherein the hand held receiver (HHR) further comprises a vibration emitter to indicate the direction of the rescue demand signal.

16. The system of claim 11, wherein the hand held receiver (HHR) further comprises a range indicator having a row of lights which turn on in relation to the distance from the rescue demand signal.

17. The system of claim 11, wherein the hand held receiver (HHR) further comprises a searchlight.

18. The system of claim 17, wherein the searchlight further comprises a laser.

19. The system of claim 1, wherein the control circuit also controls a radio receiver which receives signals from a transmitter on the display unit.

20. The system of claim 1, wherein the victim mountable alarm receiver receives a signal from a victim mountable alarm button.

21. The system of claim 1, wherein the connection further comprises an audio detector that detects an audio alarm from the victim mountable PASS system.

22. The system of claim 1, wherein the control circuit is connected to a receiver and output device to allow a remote communication to reach a victim.

23. The system of claim 1, wherein the display unit further comprises a base unit.

24. The system of claim 23, wherein the display unit further comprises a hand held receiver (HHR).

25. The system of claim 24, wherein the HHR further comprises a directional antenna.

26. The system of claim 23, wherein the base unit further comprises a directional antenna.

27. The system of claim 1, wherein the connection is an electric connection.

28. An emergency locator system comprising:

a victim mountable personal alert safety system (PASS);

a housing for the PASS;

a victim mountable alarm receiver which receives a distress signal from the PASS;

a controller connected to the alarm receiver;

said controller controlling a radio transmitter to send a rescue demand signal;

a housing for the victim mountable alarm receiver, the controller, and the radio transmitter;

an electric and/or audible connection between the PASS and the victim mountable alarm receiver;

a remote display device to receive the rescue demand signal and indicate a direction and range of the rescue demand signal; and said remote display device further comprising a hand held receiver (HHR).

29. The system of claim 28, wherein the PASS further comprises a motion detector and/or a low air sensor.

30. The system of claim 28, wherein the remote display device further comprises a base unit.

31. The system of claim 30, wherein the base unit can receive and indicate a plurality of unique rescue demand signals from a plurality of HHR's, each having a unique signature on its transmission signal.

32. The system of claim 28, wherein the HHR further comprises a visual and/or audio and/or vibration output.

33. The system of claim 28, further comprising a receiver to receive a remote signal.

34. The system of claim 28, wherein the PASS further comprises a body and/or an ambient temperature sensor.

* * * * *